US005588806A

United States Patent [19]

Trimborn et al.

[11] Patent Number: 5,588,806

[45] Date of Patent: Dec. 31, 1996

[54] LIQUID RING MACHINE AND PROCESS FOR OPERATING IT

[75] Inventors: Peter Trimborn, Feucht; Kurt-Willy Mugele, Erlangen, both of Germany

[73] Assignee: Siemens Aktiengesellschaft, Munich, Germany

[21] Appl. No.: 505,228

[22] PCT Filed: Feb. 9, 1994

[86] PCT No.: PCT/DE94/00131

§ 371 Date: Aug. 15, 1995

§ 102(e) Date: Aug. 15, 1995

[87] PCT Pub. No.: WO94/19610

PCT Pub. Date: Sep. 1, 1994

[30] Foreign Application Priority Data

Feb. 22, 1993 [DE] Germany ..... 43 05 424.2

[51] Int. Cl.[6] ..... F04B 47/12

[52] U.S. Cl. ..... 417/68; 417/54

[58] Field of Search ..... 417/54, 68

[56] References Cited

U.S. PATENT DOCUMENTS

| | | | |
|---|---|---|---|
| 2,230,405 | 2/1941 | Jennings | 230/79 |
| 3,154,240 | 10/1964 | Jennings | 417/54 |
| 3,846,046 | 11/1974 | Roe et al. | 417/54 |
| 4,323,334 | 4/1982 | Haavik | 417/68 |
| 5,366,348 | 11/1994 | Skelton | 417/68 |

FOREIGN PATENT DOCUMENTS

| | | |
|---|---|---|
| 0961653 | 4/1957 | Germany . |
| 0285570 | 1/1953 | Switzerland . |

*Primary Examiner*—Charles G. Freay
*Attorney, Agent, or Firm*— Kenyon & Kenyon

[57] ABSTRACT

A liquid ring machine has one partial working chamber of the liquid ring machine which is separated from the supply of operating liquid and is drained of the operating liquid to the point where the part of the impeller rotating in this partial working chamber does not contact the operating liquid, and this partial chamber is blocked on the suction and/or discharge side. The liquid ring machine is able to be optionally partially switched off, thus allowing an adaptation to the specific process requirements.

30 Claims, 3 Drawing Sheets

LIQUID RING MACHINE AND PROCESS FOR OPERATING IT

BACKGROUND OF THE INVENTION

The invention relates to a method for operating a liquid ring machine, as well as to a liquid ring machine for implementing the method.

In the case of a liquid ring machine disclosed by German Patent C 961 653, the working chamber is subdivided by a wall part that axially subdivides the impeller and by an intermediate wall of the housing shell arranged in the same plane with this wall part into two partial working chambers of the same size. During operation, a liquid ring forms in each partial working chamber.

Separate suction and discharge connections are assigned to each partial working chamber. In addition, the partial working chambers are interconnected in the lower region by openings, making it possible for both partial working chambers to be drained simultaneously through a shared outlet. A pump of this type is able to deliver two distinct gases having different pressures at the same time.

The CH-A 285 570 discloses a two-stage liquid ring pump, whose first stage is designed for a larger output volume than its second downstream stage. Such pumps generally experience difficulties when they have to work at a low vacuum.

In this case, the output volume of the first stage is substantially greater than that of the second stage. The second stage is not able to process the volume required by the first stage. As a result, blocking occurs, which reduces pump efficiency and can also cause damage to the pump. This working point has to be run through at every start-up operation of the pump. For this reason, it is provided in the case of this known pump for the second stage (high pressure stage) to be made inactive by removing operating liquid for so long until the ratio of the intake volume to the final volume corresponds to the ratio of the output volume of the first stage to that of the second stage. So much operating liquid is removed from the second stage, that its delivery is interrupted. Thus, the liquid ring, which requires a corresponding amount of energy for its actuation, still remains in the second liquid stage.

This invention is directed to a method of adapting a liquid ring machine to various types of loading and to provide a liquid ring machine for implementing this method.

SUMMARY OF THE INVENTION

The present invention solves this problem by a method for operating a liquid ring machine, whose apex lies in the geodetic upper area of the working chamber and whose working chamber is divided up into at least two partial working chambers, in the case of which method, at least one partial working chamber of the liquid ring machine is separated from the supply of operating liquid and is drained of the operating liquid at least to the point where the part of the impeller rotating in this partial working chamber does not come into contact with the operating liquid. This partial working chamber is also blocked on the suction and/or discharge side. The position of the apex in the geodetic upper area of the working chamber is guaranteed in that the eccentricity of the impeller is selected so as to provide adequate clearance between the unattached blade ends of the impeller and the inner housing wall of the working chamber in the geodetic lower area of the working chamber in which any existing sump liquid can collect without coming into contact with the unattached blade ends of the impeller.

By this means, a complete partial switching-off of the liquid ring machine. As a result, an adaptation of the suction capacity of the liquid ring machine to the required operating conditions is achieved that is simple and effective. This ability to adapt to the actual operating conditions is particularly advantageous, because the actual operating conditions cannot be precisely ascertained in advance in an installation of this type. In this respect, it is possible for an oversized liquid ring machine to be installed. Operational costs can then be considerably reduced by partially shutting down such a liquid ring machine. Previously, such an adjustment had only been possible in an operation using several liquid ring machines. In contrast, the method according to the present invention offers considerable savings in investment costs. Moreover, the space requirements for only one liquid ring machine operated in accordance with the method of the present invention are also considerably less.

Regulating the internal pressure minimizes the energy consumed by the part of the impeller operating at no load in a partial working chamber that is switched off. In the case of such a pressure regulation, the axial force being exerted on the impeller and, consequently, on the impeller shaft due to the pressure differences existing between the partial working chambers is kept negligibly small. It should also be mentioned that the reciprocal actions are considerably reduced at the gap that is necessitated by the operation and exists between the impeller of the liquid ring machine and the intermediate wall surrounding the impeller.

Additional energy savings are achieved by keeping the sump liquid collecting in the geodetic lower area of a switched-off partial working chamber at a level where the sump liquid does not come in contact with the impeller of the liquid ring machine.

The method can be advantageously implemented with a liquid ring machine which has, inside its machine housing, an impeller that is provided with blades. The impeller is rotationally mounted with its impeller shaft in side shields arranged on both sides of the machine housing so that the apex of the liquid ring machine lies in the geodetic upper area of the working chamber. Partial working chambers are formed with at least one wall part provided on the impeller, which extends over the entire periphery of the impeller from the impeller hub up to the unattached ends of the blades. There is on the machine housing at least one intermediate wall that is radially aligned with the wall part of the impeller. In addition, a discharge and suction connection is provided on each side shield. The connections are each in interruptible fluid flow communication via a control element provided with a suction and discharge slit with the respective partial working chamber. Also, each partial working chamber is able to be connected by itself with a liquid-discharge device and is provided with a separate operating liquid supply.

The adjustment of the internal pressure of at least one switched-off partial working chamber to more or less equal the internal pressure of at least one partial working chamber remaining in operation succeeds quite simply in that at least on one side of the liquid ring machine, the mounted suction connection is in fluid flow communication additionally via an external conduit means with a partial working chamber adjacent to the other side. The partial vacuum prevailing in the intake area that is in operation effects a draining of the switched-off part of the working chamber without any additional auxiliary devices.

The internal pressure of a switched-off partial working chamber can be regulated in the desired manner because the external conduit means has a pressure-reduction device.

For certain application cases, it can be advantageous to provide at least one partial working chamber with a connection for a drainage device. For example, a compressed-air or vacuum ductwork system that is often already available can be used to regulate the pressure economy of a switched-off partial working chamber.

When the liquid ring machine has a bearing arrangement of the impeller shaft that is able to absorb increased axial forces in addition to radial forces, it is also possible to implement the method according to the invention without additional devices for regulating the pressure economy of a switched-off partial working chamber. The axial forces occurring in the case of unregulated internal pressure are then absorbed by the suitably designed bearing arrangement.

The impeller shaft may be supported in at least one side shield by a dual-action tapered roller bearing. In addition to the radial forces, this bearing arrangement is able to absorb increased axial forces.

Although each partial working chamber by itself can be joined to a liquid-discharge device, the supply of operating liquid is advantageously provided on at least one machine side with a shutoff element so as to ensure right from the start that operating liquid will not be unnecessarily supplied in the event of a partial cutoff. The blocking of the supply of operating liquid can also take place as a controlled operation.

The shaft seals, situated in the side shields, are constructed to restrict the entry of atmospheric gas into a switched-off partial working chamber. Otherwise, the atmospheric gas pressure that ensues in this passive part of the working chamber could adversely affect the power efficiency of the liquid ring machine, or unnecessarily stress the automatic control of the pressure economy for this partial working chamber.

To be able to freely choose the partial working chamber to be switched off, it is advantageous to subdivide into equal-sized partial working chambers so that the axial impeller subdivision and the intermediate wall are preferably arranged in the middle of the machine. Such a subdivision offers additional advantages from a standpoint of production engineering, since both partial working chambers can be designed with equal dimensions.

To implement the method, it is advantageous to use a liquid ring machine whose apex is situated in the geodetic upper area of the working chamber. This ensures that the eccentricity of the impeller is selected so as to provide adequate clearance between the unattached blade ends of the impeller and the inner housing wall of the working chamber in the geodetic lower area of the working chamber in which any existing sump liquid can collect without coming into contact with the unattached blade ends of the impeller.

The liquid ring machine can be partially drained quickly through a separate drainage opening in each partial working chamber so that the partial switching-off is able to be implemented immediately in case of need. The drainage opening of at least one partial working chamber may be connected in each case to the operating liquid supply of at least one other partial working chamber.

The operating liquid flowing out of the switched-off partial working chamber in the event of a partial switch-off is fed to the supply of operating liquid of a partial working chamber currently in operation in that the drainage opening of at least one partial working chamber is connected in each case to the operating liquid supply of at least one other partial working chamber.

Because the drainage opening of at least one partial working chamber is connected to the compression area of at least one other partial working chamber, the sump liquid collecting in the geodetic lower area of the switched-off part of the working chamber is automatically suctioned into the remaining working chamber currently in operation, since the pressure prevailing in the compression area of the partial working chamber currently in operation is less than the pressure ensuing in a switched-off partial working chamber, provided that no additional means are provided for adjusting the internal pressure for the switched-off partial working chamber. Consequently, no further precautions need to be taken for discharging the sump liquid.

One acceptable way to automatically recirculate the sump liquid in a partial working chamber that is in operation is connecting the drainage opening of at least one partial working chamber with the intake area of at least one other partial working chamber. The pressure difference between the intake area of a partial working chamber that is currently in operation and a switched-off partial working chamber causes the sump liquid to flow into a partial working chamber that is currently in operation.

The above-mentioned connections that lead away from the outlet orifices of the partial working chambers are designed most effectively as pipes. These ducts can then be optionally arranged inside or outside of the machine housing.

It is possible to drain the partial working chamber provided for the switch-off operation more rapidly and effectively, as well as to automatically control the sump liquid overflowing into this partial working chamber to a constant level by connecting at least one controllable extraction pump to the partial working chambers.

Due to the fact that the gap between the impeller and the intermediate wall surrounding the impeller is provided with a contact-free seal, the reciprocal actions at this gap, in particular the overflowing of operating liquid between a partial working chamber remaining in operation and a switched-off partial working chamber are kept to a minimum. The inside radial edge of the intermediate wall has a fastening groove for a Teflon strip, whose width generally corresponds to the width of the gap between the impeller and the intermediate wall. The intermediate wall may also have a continuous connecting port in the geodetic lower area.

When no automatic control of the pressure economy is provided for a switched-off partial working chamber, an internal pressure gradually ensues in this working chamber that is elevated compared to a pressure prevailing in the partial working chamber currently in operation. This pressure difference can be utilized to discharge the sump liquid. Because an intermediate wall that divides up the partial working chambers has a continuous connecting port in the geodetic lower area, the sump liquid flows back through this port, following the ensuing pressure drop into a partial working chamber that is currently in operation.

DETAILED DESCRIPTION

Figure 1:
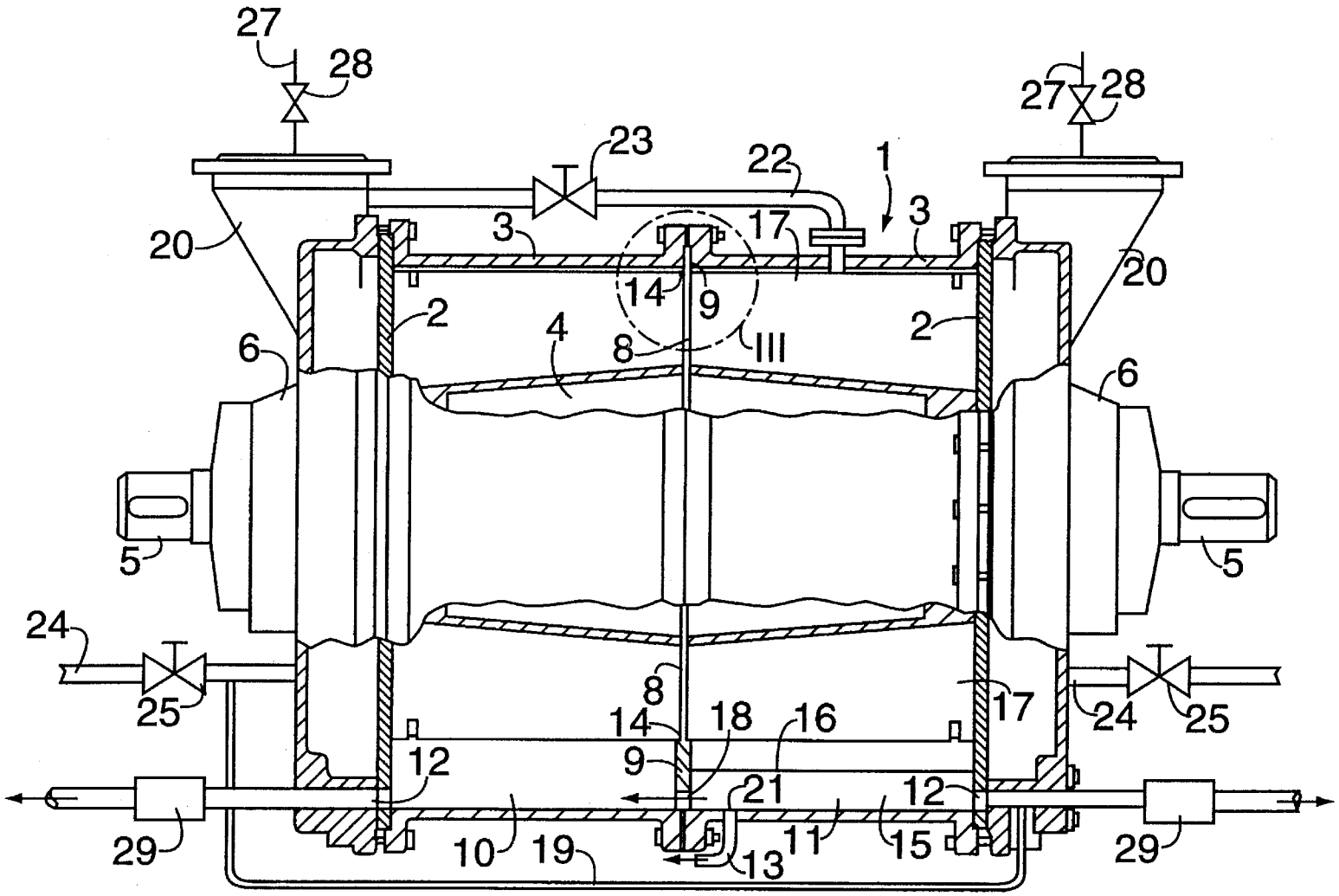
FIG. 1 is a longitudinal cross-sectional view of an example of the liquid ring machine according to an embodiment of the present invention.

As shown in FIG. 1, the liquid ring machine 1 has a working chamber formed by a machine housing 3 that is closed off on the front side by flat control disks 2. Provided inside of this working chamber is an impeller 4 that is provided with blades and whose axis is arranged eccentrically to the axis of the machine housing 3. The shaft 5 of the impeller 4 is rotationally mounted in side shields 6 of the liquid ring machine 1 connected to the machine housing 3. To seal off the shaft, stuffing-box packing (not visible) is provided in the side shields 6.

The impeller 4 is axially subdivided in the middle by a wall part 8, which extends over the entire periphery of the impeller 4 and reaches in the radial direction from the impeller hub up to the unattached ends of the blades of the impeller 4. Lying in one plane with the wall part 8, an intermediate wall 9 is provided that concentrically surrounds the impeller 4 and is fixed to the machine housing 3. A gap 14 necessitated by the operation exists between the wall part 8 and the intermediate wall 9.

A subdivision of the working chamber into two equally sized partial working chambers 10, 11 is given because of the wall part 8 and the intermediate wall 9, a distinction being made, furthermore, between a switched-off partial working chamber; the passive partial working chamber 11, and a partial working chamber currently in operation, the active working chamber 10. Usually, both partial working chambers 10, 11 have the same design and, consequently, each partial working chamber 10, 11 is able to be used by itself as an active or passive partial working chamber 10 or 11. In the drawing, only one partial working chamber is shown as a passive partial working chamber 11. This passive partial working chamber 11 is provided with a drainage opening 12 which is suited for completely draining it and which is in fluid flow communication with a conduit means 19. A sump outlet 21 with a relief connection 13 is arranged in the geodetic lower area of the partial working chamber 11.

Figure 2:
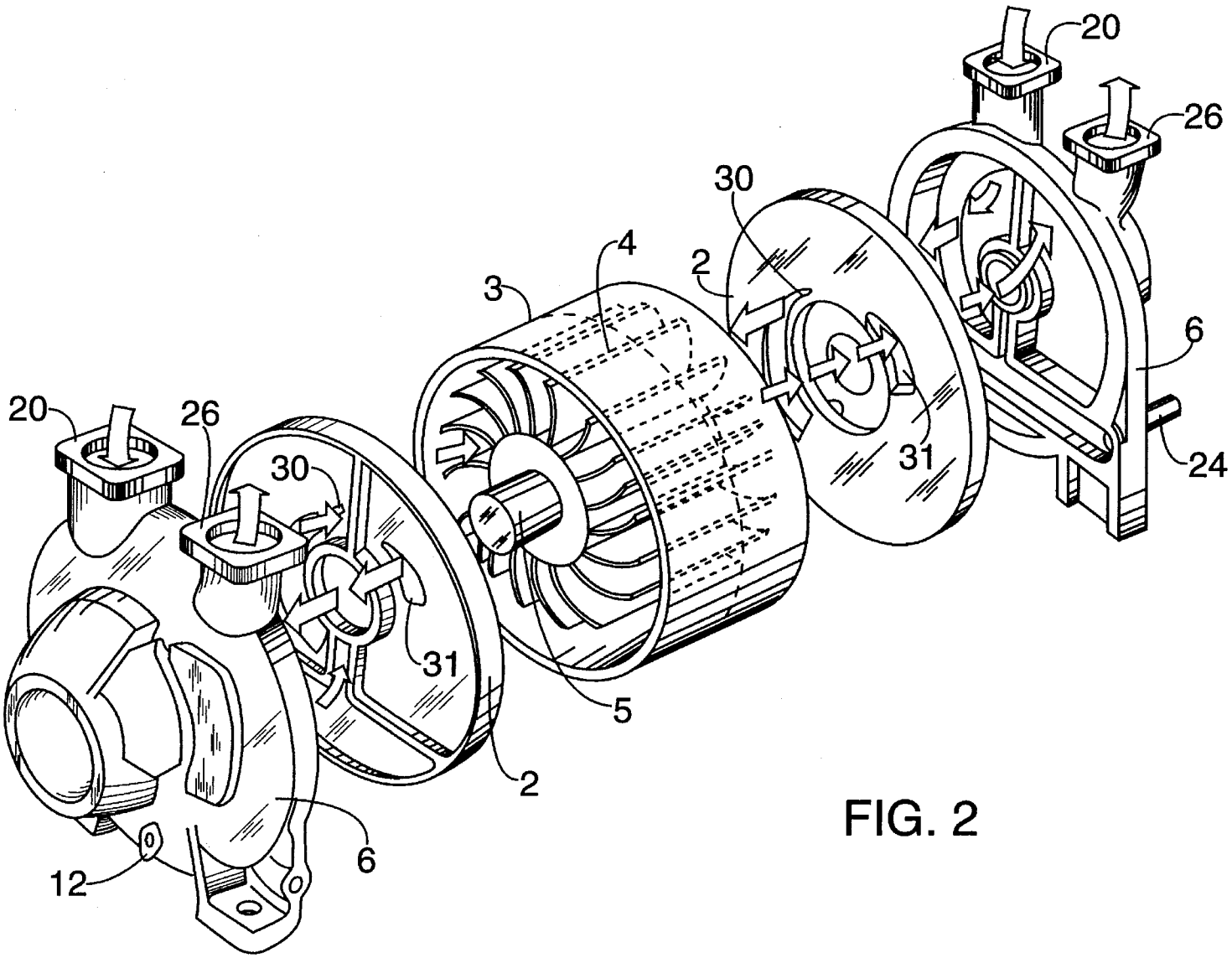
FIG. 2 is an exploded view of the liquid ring machine of FIG. 1.

Both partial working chambers 10, 11 are provided with discharge and suction connections 20, only the suction connection 20 being visible in the drawing. In FIG. 2, the suction and delivery slits 30 and 31 in each control disk 2 are shown. The flow paths flow medium flowing in through the suction connection 20 and flowing out through the discharge connection 26 are shown with arrows in FIG. 2. The passive partial working chamber 11 is connected via a drainage line 22 with the suction connection 20 of the active partial working chamber 10. The drainage line 22 is provided with a control valve 23. A possible equally acting connection of the active partial working chamber 10 with the suction connection 20 adjacent to the passive partial working chamber 11 is not drawn in.

In the event of a partial switching-off of the liquid ring machine 1, the connection of the corresponding machine side 1 with the flow medium via the discharge and suction connections 20 is initially interrupted. A suction pipe 27 is connected to the suction connection 20. The suction pipe 27 can be blocked by a valve 28 to prevent flow medium from flowing so that the corresponding working chamber, for example partial working chamber 11, is switched off. The separate supplying of the one partial working chamber 11 with operating liquid is likewise switched off. Simultaneously with the blocking off of the supply of the flow medium, the supply of operating liquid is also blocked off for the partial working chamber 11. This is done by a shutoff valve 25 arranged in the operating liquid supply line 24. At the same time, the drainage opening 12 is opened, so that the operating liquid of the now passive partial working chamber 11 can flow out. In order to carry out drainage of the switched-off partial working chamber 11 more quickly, a controllable extraction pump 29 can be connected to the drainage opening 12 to drain operating liquid still present in the switched-off partial working chamber 11. The operating liquid flowing out of the passive partial working chamber 11 can be supplied via the conduit means 19 to the operating liquid supply of the active partial working chamber 10.

Figure 3:
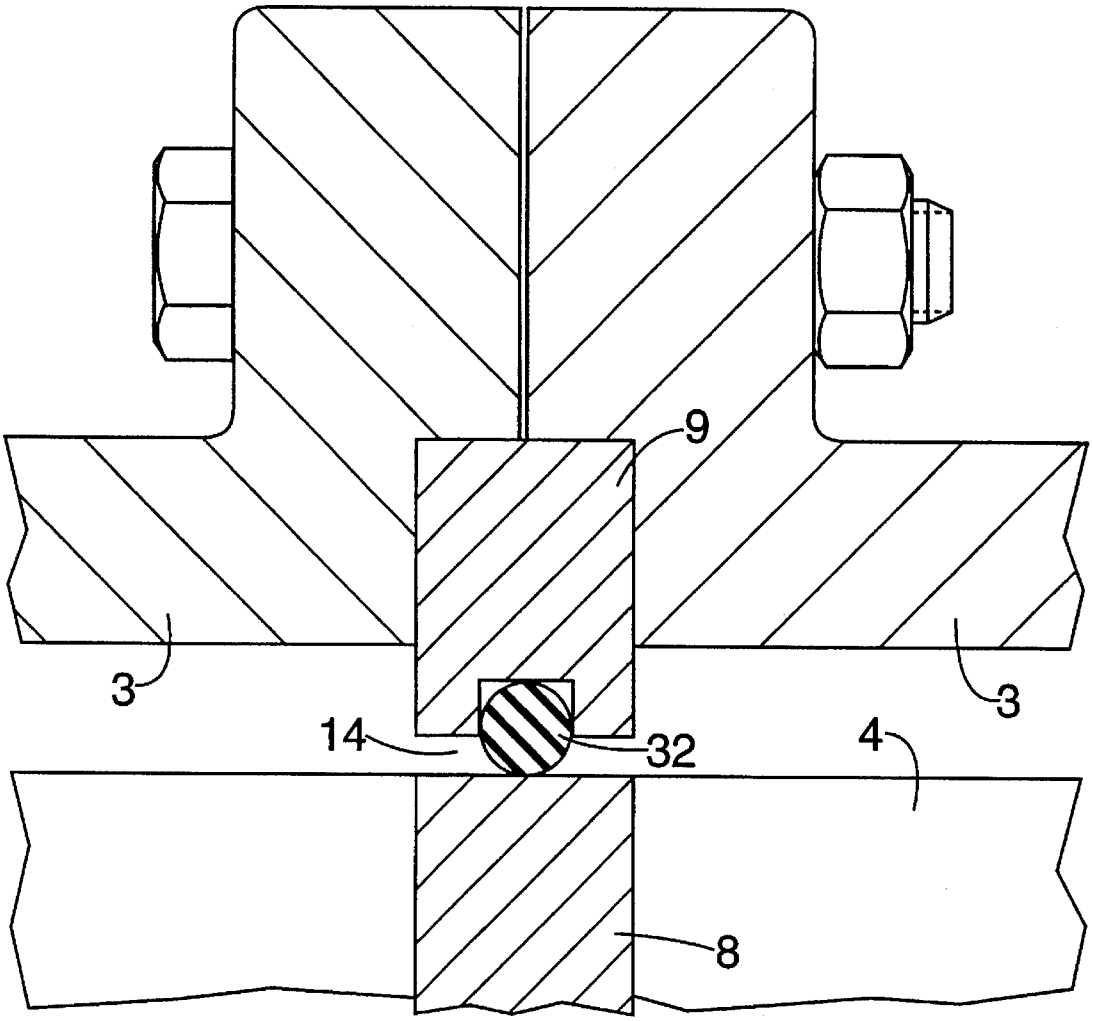
FIG. 3 is a detail view of area III in FIG. 1.

After the passive partial working chamber 11 is emptied, the liquid ring machine 1 works in a partially switched-off state. Operating liquid now flows out of the active partial working chamber 10 through the gap 14 necessitated by the operation between the wall part 8 and the intermediate wall 9, over to the passive partial working chamber 11. As shown in FIG 3, a teflon strip 32 is inserted into a fastening groove in the radial inside edge of intermediate wall 9 to seal the two partial working chambers 10 and 11 relatively to each other. The teflon ring 32 is a seal in the gap 14 between the wall part 8 of the impeller 4 and the intermediate wall 9. As a result, a sump liquid 15, whose level 16, if at all possible, should not reach the blade area 17 of the impeller 4, collects in the lower area of the passive partial working chamber 11. For this reason, to drain off the sump liquid 15 into both partial working chambers 10 and 11, separate outlet orifices are provided, which are only drawn in for the passive partial working chamber 11. In the exemplary embodiment depicted in the drawing, several possibilities for developing the outlet orifices are shown, these outlet orifices being able to be used individually or jointly. A sump drain 21 provided in the geodetic lower area of the machine housing 3 serves as an outlet orifice. The sump liquid 15 flowing out here can also be supplied via another relief connection 13 to the operating liquid of the active partial working chamber 10. The sump drain 21 can also be connected to a barometric tube, whose level is determined by the internal pressure and the level of the sump liquid. A connecting port 18 situated in the intermediate wall 9 likewise fulfills the function of an outlet orifice for the sump liquid 15. The sump liquid 15 flows through this connecting port 18 directly over into the active partial working chamber 10, since in spite of an improved shaft seal as the result of properly designed stuffing-box packing, a pressure rise in the passive partial working chamber 11 can take place and, as a result, a pressure drop from the passive partial working chamber 11 toward the active partial working chamber 10 ensues, which the sump liquid 15 follows.

In the case of an operation of the liquid ring machine 1 is necessary to regulate the internal pressure of the passive partial working chamber 11 to be less than or, at the most, equal to the internal pressure of the active partial working chamber 10. This is simply effected by connecting the passive partial working chamber 11 via a drainage line 22 with the suction connection 20 of the active partial working chamber 10. The partial vacuum prevailing at this point also ensues then in the passive partial working chamber 11. Another possibility for intervention is given by a control valve 23 in the drainage line 22. Thus, the internal pressure of the passive partial working chamber 11 can be so adjusted that, as already described, any existing sump liquid flows out through the outlet orifices provided for that purpose.

We claim:

1. A method for operating a liquid ring machine comprising the steps of:

providing a working chamber within the liquid ring machine, the working chamber having an apex in the geodetic upper area and a rotatable impeller, wherein the working chamber is divided into at least two partial working chambers;

providing a supply of operating liquid;

separating at least one partial working chamber from the supply of operating liquid;

blocking the partial working chamber on either the suction side or the discharge side or both; and draining the supply of operating liquid from the at least one partial working chamber so that the operating liquid does not contact the rotating impeller in the at least one partial working chamber, while another partial working chamber remains in operation so that the operating liquid does contact the rotating impeller in the another partial working chamber.

2. The method of operating a liquid ring machine according to claim 1, further comprising the step of:

adjusting the internal pressure of a switched-off partial working chamber to generally equal the intake pressure of at least one partial working chamber remaining in operation.

3. The method of operating a liquid ring machine according to claim 1, further comprising the step of:

maintaining a level of sump liquid collecting in the geodetic lower area of a switched-off partial working chamber as a result of operating liquid overflowing out of a currently operating partial working chamber at a level so that the sump liquid does not contact the rotating impeller in a switched-off partial working chamber.

4. The method of operating a liquid ring machine according to claim 2, further comprising the step of:

maintaining a level of sump liquid collecting in the geodetic lower area of the switched-off partial working chamber as a result of operating liquid overflowing out of the currently operating partial working chamber at a level so that the sump liquid does not contact the rotating impeller in the switched-off partial working chamber.

5. A liquid ring machine comprising:

a housing having two opposite ends;

a working chamber within the housing having a geodetic upper area and a geodetic lower area and an apex in the geodetic upper area of the working chamber;

two side shields, wherein each side shield is disposed at each of the housing ends;

a shaft extending through the housing and rotatably mounted at opposite ends at the two side shields;

an impeller having a hub, wherein the impeller is mounted to the shaft;

a plurality of blades attached at one end to the impeller hub;

at least one wall part on the impeller, wherein each said wall part extends over the entire periphery of the impeller from the impeller hub up to unattached ends of the blades;

at least one intermediate wall attached to the housing, wherein each said intermediate wall is in radial alignment with the wall part of the impeller and a gap exists between the wall part and the intermediate wall surrounding the wall part, and wherein the at least one wall part and the at least one intermediate wall cooperate to divide the working chamber into at least two partial working chambers, each of the partial working chambers being connectable to at least one liquid-discharge device;

a plurality of operating liquid supplies for providing operating liquid to the partial working chambers, wherein each partial working chamber is connected to a separate operating liquid supply;

two discharge and suction connections, wherein each discharge and suction connection is connected to one of the side shields and has a control element with a suction and discharge slit so that each discharge and suction connection is in interruptable fluid flow communication with one of the partial working chambers; and wherein at least one partial working chamber is separated from the supply of operating liquid and is drained of the operating liquid at least to the point where the blades of the impeller rotating in the at least one partial working chamber do not contact the operating liquid in the at least one partial working chamber, and wherein the blades of the impeller rotating in another partial working chamber do contact operating liquid in the another partial working chamber.

6. The liquid ring machine according to claim 5, wherein sump liquid which collects in the geodetic lower area of a switched-off partial working chamber as a result of operating liquid overflowing out of a currently operating partial working chamber is maintained at a level so that the sump liquid does not contact the rotating impeller in the switched-off partial working chamber.

7. The liquid ring machine according to claim 5, further comprising an external drain line connected to at least one partial working chamber, wherein one of the discharge and suction connections disposed on one of the side shields is also in fluid flow communication via the external drain line with the partial working chamber adjacent to the other side shield so that the internal pressure of a switched-off partial working chamber can be adjusted to generally equal the intake pressure of at least one partial working chamber remaining in operation.

8. The liquid ring machine according to claim 7, wherein the external drain line has a pressure reduction valve.

9. The liquid ring machine according to claim 5, wherein at least one partial working chamber has a drainage device connection.

10. The liquid ring machine according to claim 7, wherein at least one partial working chamber has a drainage device connection.

11. The liquid ring machine according to claim 5, wherein at least one of the operating liquid supplies includes a shutoff element.

12. The liquid ring machine according to claim 7, wherein at least one of the operating liquid supplies includes a shutoff element.

13. The liquid ring machine according to claim 5, further comprising two shaft seals, wherein each shaft seal is disposed in one of the side shields to restrict the entry of atmospheric gas.

14. The liquid ring machine according to claim 5, wherein the at least one wall part and the at least one intermediate wall are arranged in the middle of the liquid ring machine.

15. The liquid ring machine according to claim 5, wherein each partial working chamber has a drainage opening suitable for completely draining the partial working chamber.

16. The liquid ring machine according to claim 6, wherein each partial working chamber has a drainage opening suitable for completely draining the partial working chamber.

17. The liquid ring machine according to claim 15, wherein the drainage opening of at least one partial working chamber is connected to the operating liquid supply of at least one other partial working chamber.

18. The liquid ring machine according to claim 15, wherein the drainage opening of at least one partial working chamber is connected to a compression area of at least one other partial working chamber.

19. The liquid ring machine according to claim 16, wherein the drainage opening of at least one partial working chamber is connected to a compression area of at least one other partial working chamber.

20. The liquid ring machine according to claim 15, wherein the drainage opening of at least one partial working chamber is connected to an intake area of at least one other partial working chamber.

21. The liquid ring machine according to claim 16, wherein the drainage opening of at least one partial working chamber is connected to an intake area of at least one other partial working chamber.

22. The liquid ring machine according to claim 17, wherein the drainage openings include pipes.

23. The liquid ring machine according to claim 6, further comprising at least one controllable extraction pump, wherein one of the at least one liquid-discharge device is connected to one of the at least one controllable extraction pump.

24. The liquid ring machine according to claim 7, further comprising at least one controllable extraction pump, wherein one of the at least one liquid-discharge device is connected to one of the at least one controllable extraction pump.

25. The liquid ring machine according to claim 5, wherein the radial inside edge of the intermediate wall has a fastening groove to receive a Teflon strip, wherein the width of the groove generally corresponds to the width of the gap between the wall part of the impeller and the intermediate wall.

26. The liquid ring machine according to claim 5, wherein the intermediate wall has a continuous connecting port in the geodetic lower area of the working chamber.

27. The liquid ring machine according to claim 6, wherein the intermediate wall has a continuous connecting port in the geodetic lower area of the working chamber.

28. A liquid ring machine having a supply of operating liquid, comprising:

a working chamber having a lower geodetic area and an apex in an upper area of said working chamber;

dividing means for dividing the working chamber into at least two partial working chambers; and an impeller rotatably mounted in the working chamber, wherein the impeller is eccentrically located within the working chamber so that the rotating impeller adequately clears both the inner wall of the working chamber and any operating liquid that collects in the lower geodetic portion of a switched-off partial working chamber, wherein the switched-off partial working chamber is separated from the supply of operating liquid and is drained of the operating liquid at least to the point where the impeller in the switched-off partial working chamber does not contact the operating liquid, and wherein the impeller rotating in another, not switched-off, partial working chamber does contact operating liquid in the another partial working chamber.

29. The liquid ring machine according to 28, further comprising pressure adjusting means for adjusting the internal pressure of the switched-off partial working chamber to generally equal the intake pressure of at least one working chamber remaining in operation.

30. The liquid ring machine according to claim 28, further comprising sump level control means for controlling the level of operating liquid in the switched-off partial working chamber so that the operating liquid does not come in contact with the rotating impeller in the switched-off partial working chamber.

* * * * *